US005921412A

United States Patent [19]

Merl

[11] Patent Number: 5,921,412

[45] Date of Patent: Jul. 13, 1999

[54] SHELF ASSEMBLY

[76] Inventor: Milton J. Merl, 50 Wilcox Rd., Stonington, Conn. 06830

[21] Appl. No.: 08/923,766

[22] Filed: Sep. 2, 1997

[51] Int. Cl.[6] ..... A47F 5/00

[52] U.S. Cl. ..... 211/90.03; 211/59.2; 211/90.02; 211/187; 211/181.1

[58] Field of Search ..... 211/90.03, 90.02, 211/90.01, 90.04, 103, 187, 181.1, 106, 59.2, 85.31; 108/181

[56] References Cited

U.S. PATENT DOCUMENTS

| | | | |
|---|---|---|---|
| 2,560,896 | 7/1951 | Rubenstein | 211/106 |
| 2,643,002 | 6/1953 | Rubenstein | 211/106 |
| 3,730,108 | 5/1973 | Stroh | 211/181.1 X |
| 4,109,797 | 8/1978 | Brunette | 211/126 |
| 4,248,352 | 2/1981 | White | 211/88 |
| 4,511,047 | 4/1985 | Elinsky | 211/106 X |
| 4,955,486 | 9/1990 | Trulaske | 211/59.2 |
| 5,076,443 | 12/1991 | Trulaske | 211/59.2 |
| 5,240,124 | 8/1993 | Buday | 211/181.1 X |
| 5,305,898 | 4/1994 | Merl | 211/87 |
| 5,472,103 | 12/1995 | Merl | 211/187 |
| 5,480,039 | 1/1996 | Merl | 211/88 |
| 5,509,541 | 4/1996 | Merl | 211/103 |

*Primary Examiner*—Robert W. Gibson, Jr.
*Attorney, Agent, or Firm*—Schweitzer Corman Gross & Bondell, LLP

[57] ABSTRACT

A shelf assembly suitable for displaying products in refrigerated environments has a wire mat mounted to two brackets. The wire mat has a plurality of spaced-apart, parallel product support rods having integral, downwardly-extending, U-shaped portions in which cross bars are welded. The tops of the cross bars and product support bars are co-planar forming a substantially planar product supporting surface. Stiffening members are welded to the bottom surfaces of the U-shaped portions to impart rigidity to the wire mat. A rearward end bar engages one of a plurality of locking slots in the mounting brackets to provide a plurality of positions for the wire mat. Guide rails extending over the wire mat define discrete product channels. Forwardly-extending portions of the product supporting rods form extensions to the product channels to which product label holders can be mounted. A shelf extension is removably mountable between the brackets when the wire mat is in a forward position.

14 Claims, 8 Drawing Sheets

SHELF ASSEMBLY

The present invention relates to a merchandising system and more particularly to an improved wire mat shelving assembly for use in conjunction with currently available store shelf mounts and gondolas.

BACKGROUND OF THE INVENTION

The majority of inventory in retail stores is carried in a form of shelving construction utilizing gondolas or trays for the products. Such format has changed little over the years. A floor platform supports a vertical upright backing board which defines the gondola. The gondola includes vertical weight-supporting uprights having a plurality of vertical slots. The slots and uprights are adapted to support shelving and other elements in or on which merchandise is placed for display. While such gondolas are typically employed for the display of goods directly on the selling floor, similar structures are employed in freezer cases and the like for the display and storage of refrigerated goods.

Such gondolas are required to display and support an ever increasing number of products in a staggering assortment of packaging and in an ever decreasing amount of space. However, the current gondola shelving systems typically use space relatively inefficiently and are ill-equipped to handle a variety of products. The result is that there is typically not enough gondola space available to keep and display all the desired products neatly and efficiently.

Conventional gondola shelving generally consists of a horizontal shelf supported by outwardly-extending brackets connected to vertical supports. To reduce their weight and cost, such shelves can be constructed of interconnecting wire rods forming a wire mesh or mat. Such wire mat shelves are used most often in refrigerated environments because they do not inhibit air flow significantly.

Typically, the openwork layer of wire rods of such shelves forms a horizontal support surface over which products can slide. However, the shelf does not provide control for the motion of the products which can therefore become mixed and disorganized. Also, the front-to-back position of such prior art shelves is fixed, limiting the flexibility of the shelf system.

Therefore, what is desired is a shelving system which includes a wire mat shelf of a light-weight and economical construction which is rigid and able to support a significant amount of weight, which has a means to control the movement of products thereon, and which is adjustable to efficiently display products of varying sizes and shapes.

OBJECTS AND ADVANTAGES OF THE PRESENT INVENTION

Accordingly, an object of the present invention is to provide an improved wire mat shelf assembly which utilizes display space efficiently.

Another object of the present invention is to provide an improved wire mat shelf assembly which can be incorporated in a gondola system adapted to efficiently accommodate products of varying shapes and sizes.

Still another object of the present invention is to provide an improved wire mat shelf assembly of the above character which is light-weight and economical to manufacture.

Yet another object of the present invention is to provide an improved wire mat shelf assembly of the above character which is rigid and strong and which has a low profile such that it occupies a minimum amount of space.

A further object of the present invention is to provide an improved wire mat shelf assembly with means to organize the products supported thereon.

BRIEF DESCRIPTION OF THE INVENTION

In accordance with the foregoing and other objects, the present invention consists of a space-efficient gondola shelf assembly which can be incorporated in a shelving system adapted for products having various sizes and shapes. The shelf assembly includes a wire mat which is comprised of a plurality of spaced-apart parallel product support rods connected by several spaced-apart cross bars. Stiffening members extend horizontally below the support and cross bars. The cross bars engage slots in shelf support brackets, which slots provide a plurality of mounting positions for the wire mat, such that the front-to-back position of the wire mat can be adjusted relative to the brackets.

Extending upwardly from and horizontally over the wire mat are a plurality of guide rails adapted to organize products in rows, aligned front-to-back. Opposite ends of the guide rails are mounted to end bars connected to opposed ends of the product support rods. Pairs of interconnected support rods form loops extending forwardly from the wire mat, which loops are aligned with the product rows to form a support for the forwardmost article in each row.

The shelf assembly is designed to cooperate with and compliment the shelving support system described in U.S. patent application Ser. No. 08/578,104, the disclosure of which is herein incorporated by reference. Such shelving support system consists of a rigid structure which mounts on the vertical supports of a conventional gondola system and which provides a means for fine adjustment of the placement of shelves. Specifically, the shelving support system comprises end brackets which mount onto the vertical supports of a conventional gondola system, crossbars which mount on the end brackets, and auxiliary vertical uprights which mount on the crossbars. The auxiliary uprights include vertical columns of closely-spaced slots which provide an increased number of mounting positions for the brackets. The vertical position of the shelving support system relative to the gondola can also be adjusted to provide further flexibility.

The shelf brackets of the present invention are preferably adapted to mount on the auxiliary vertical supports such that the shelf assembly can be used in conjunction with such a shelving support system.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE INVENTION

Figure 1:
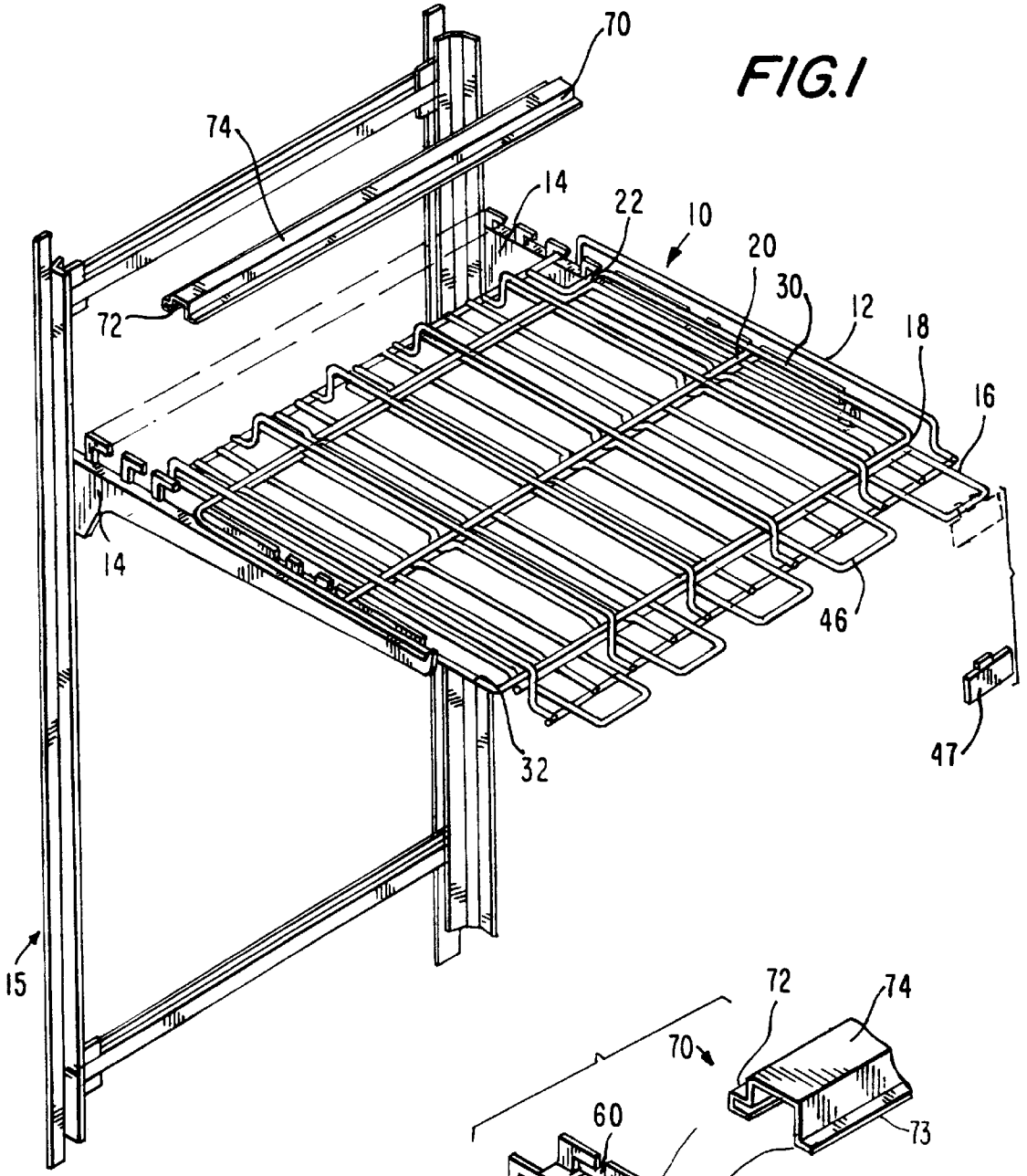
FIG. 1 is a top perspective view of a shelf assembly of the present invention mounted to a support structure.
Figure 1A:
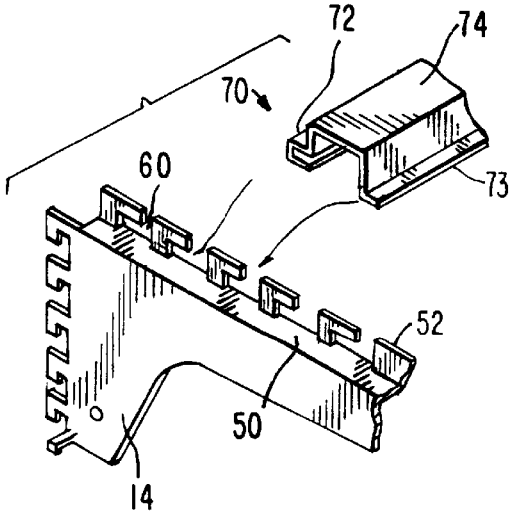

Referring to the drawings, and in particular to FIGS. 1–5 and 9 thereof, the shelf assembly 10 of the present invention comprises a rigid wire mat 12 mounted on brackets 14, which, in turn, are mounted to a gondola or other support structure 15. The wire mat includes a plurality of product support rods 16 oriented front-to-back, and preferably three cross bars 18, 20, 22 oriented side-to-side and welded to the product support rods 16. The product support rods 16 are preferably formed of 3/16" wire rod and the cross bars are preferably formed of 3/8" wire rod.

The ends 24 of the cross bars 18, 20, 22 are connected by two side bars 30, 32 which rest on inwardly-turned, horizontal surfaces 50 of the brackets 14, (best seen in FIG. 5) thereby providing support for the wire mat 12. Preferably, the side bars 30, 32 and the forwardmost cross bar 18 are integral, formed of a single piece of stock, while the middle and rearward most cross bars 20, 22 are T-welded to interior sides of the side bars 30, 32.

Figure 2:
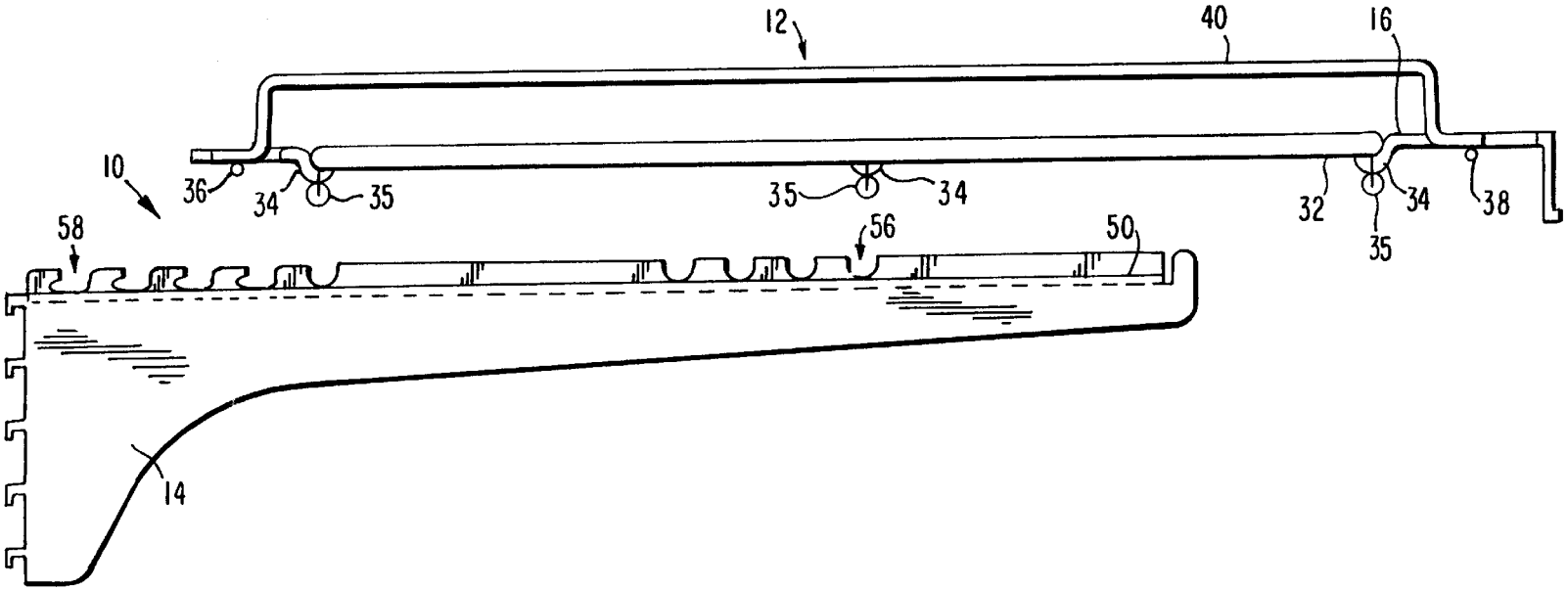
FIG. 2 is an exploded side elevational view of a shelf assembly of FIG. 1.

As best seen in FIG. 2, the product support rods 16 include preferably integral, downwardly-extending U-shaped portions 34 aligned with, and extending below, the cross bars 18, 20, 22. the U-shaped portions 34 are preferably shaped and sized to accommodate the entire diameter of the cross bars 18, 20, 22 such that, when welded therein, the tops of the cross bars 18, 20, 22 are flush with the tops of the product support rods 16, thereby forming a substantially planar product supporting surface.

Figure 3:
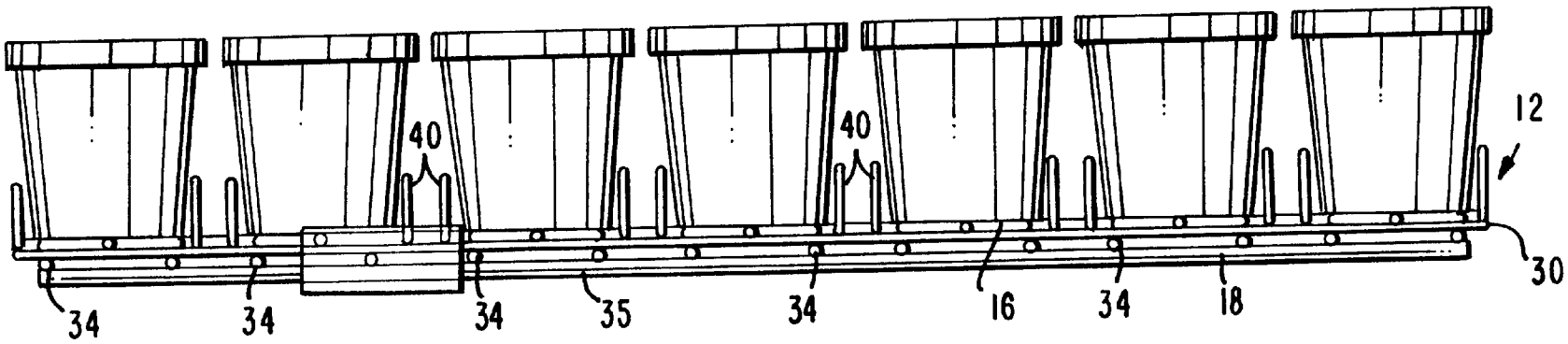
FIG. 3 is a front elevational view of the wire mat of the shelf assembly of FIG. 2.
Figure 5:
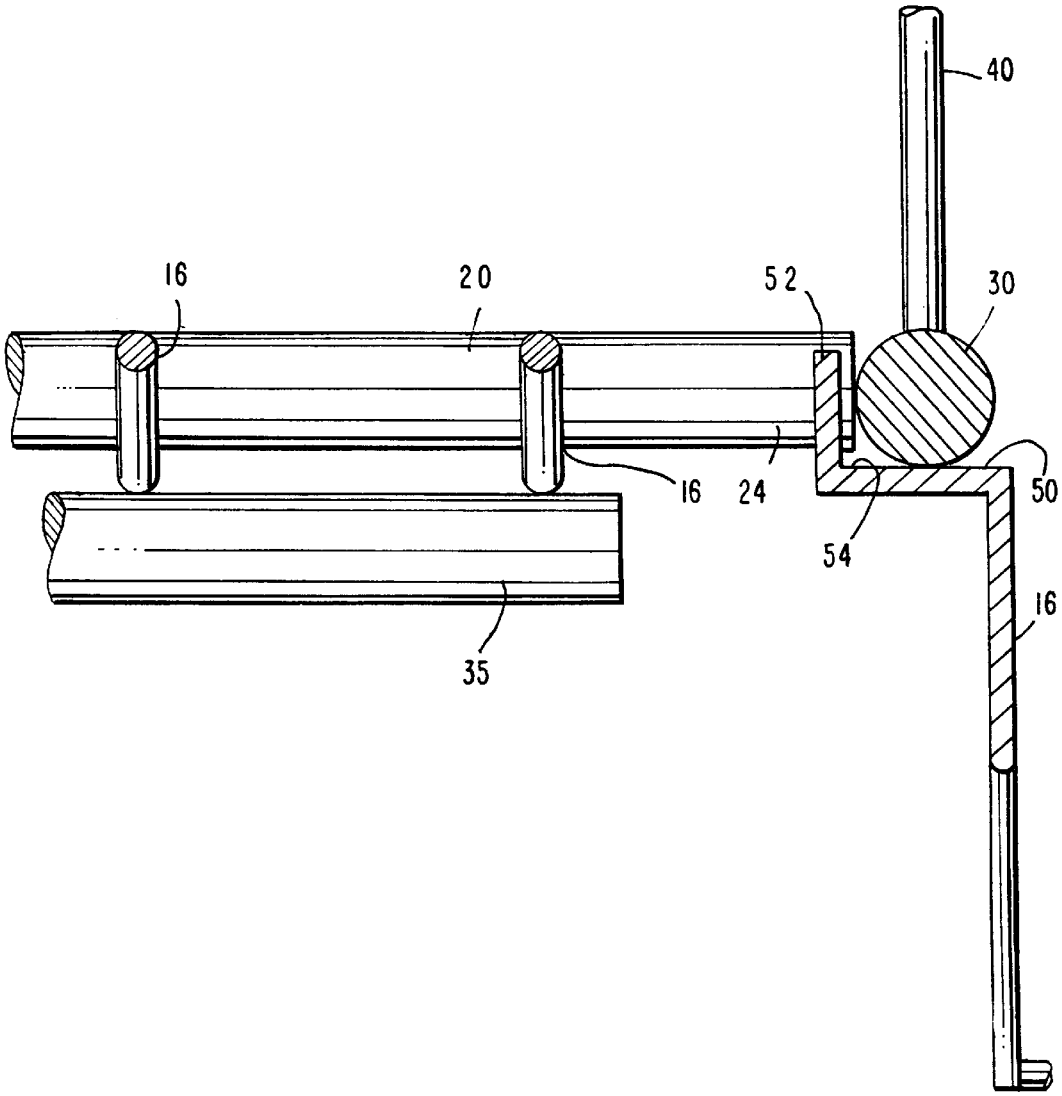
FIG. 5 is an cross-sectional, elevational view taken along line 5—5 of FIG. 4.

The wire mat 12 also includes preferably three cross-wise stiffening members 35 welded to the bottom surfaces of the U-shaped portions 34 of the product support rods 16. The stiffening members 35, which can be 3/8" wire rod, and are preferably aligned directly underneath and parallel to the cross bars 18, 20, 22. The U-shaped portions 34 serve to rigidly connect, yet separate, each stiffening member 35 from the associated cross bar 18, 20, 22 thereby providing a stiff, I-beam-like support structure for the wire mat 12. As depicted in FIGS. 3 and 5, the stiffening members 35 preferably terminate inward of the side bars 30, 32 so as not to interfere with the mounting and removal of the wire mat 12 from the brackets 14.

Figure 4:
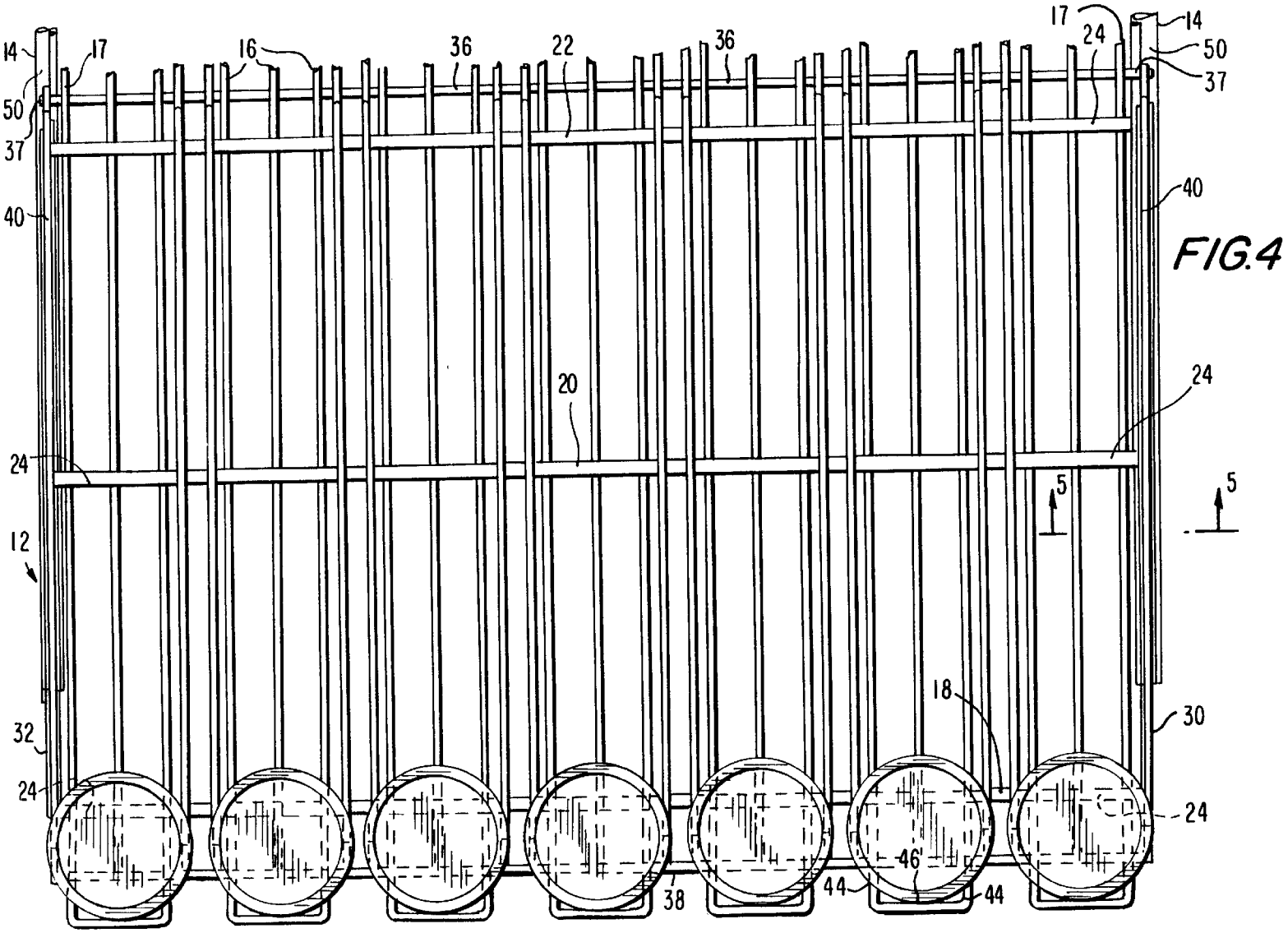
FIG. 4 is a top plan view of the shelf assembly of FIG. 2.

Referring to FIG. 4, the wire mat 12 also includes rearward and forward end bars 36, 38 oriented perpendicular to and welded to the underside of the product support rods 16. As will be further described below, the rearward end bar 36 includes outwardly-projecting ends 37 which releasably engage the brackets 14 to hold the rearward end of the wire mat 12 down. Referring to FIG. 2, the end bars 36, 38 are preferably of 3/16" in diameter such that the bottom-most portions thereof align with the bottommost portions of the side bars 30, 32, as shown.

Referring to FIGS. 2–4, guide rails 40, oriented front-to-back upon the mat, are preferably welded to the rearward and forward end bars 36, 38 of the wire mat 12. The guide rails 40, which can be formed of 3/16" wire rod, project upwardly from the wire mat 12, preferably parallel to the product support rods 16, forming product channels therebetween to organize and control product movement on the shelf. If the products intended to be supported have relatively vertical side walls, then the shelf assembly 10 need only have one such guide rail between each product row. However, if the products have outwardly-slanted side walls, such as those of pint-sized ice cream containers depicted in FIG. 3, two spaced-apart guide rails 40 may be desirable as depicted thereon to insure that the tops of the products do not contact one another.

Figure 9:
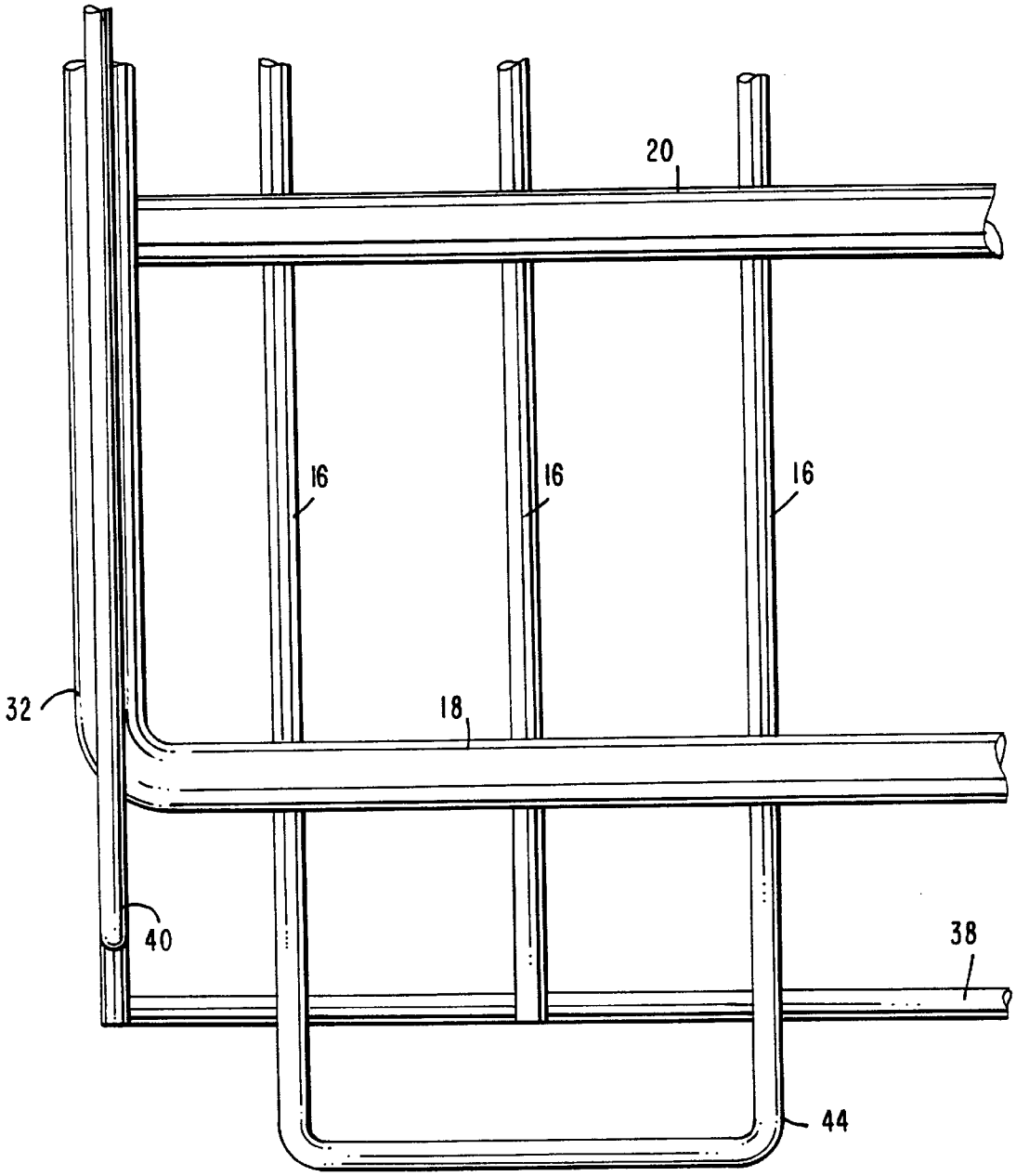
FIG. 9 is a sectional, top plan view of a front corner of the wire mat.

Referring to FIGS. 4 and 9, the product support rods 16 can terminate at the forward end bar 38. However, preferably two extended product support rods 44 of each product row extend forwardly and are joined by a front bar 46 to an outwardly-extending product support. As depicted, the two extended product support rods 44 and the front bar 46 can be integral and of one-piece construction. Preferably, the guide rails 40 are located across the mat such that the outwardly extending product support formed by the extended product support rods 44 and the front bar 46 is centered between pairs thereof. As shown in FIG. 1, the front bar 46 can also serve as a label holder support, whereby a plastic label holder 47 can be clipped or otherwise mounted in centered alignment with a product row.

Figure 6:
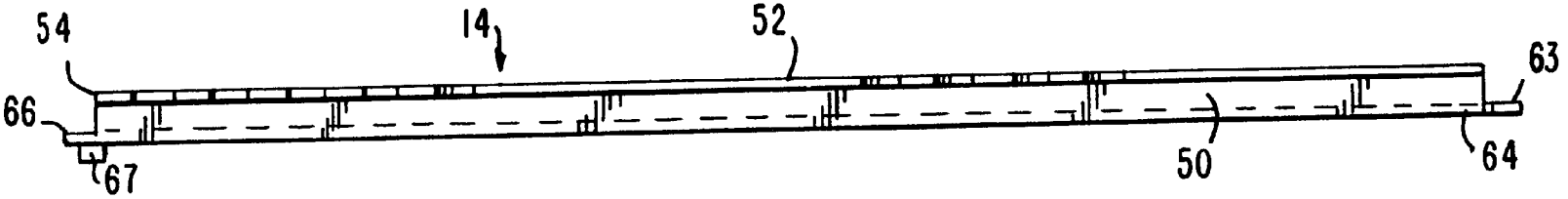
FIG. 6 is a top plan view of the bracket of the shelf assembly of FIG. 2.
Figure 7:
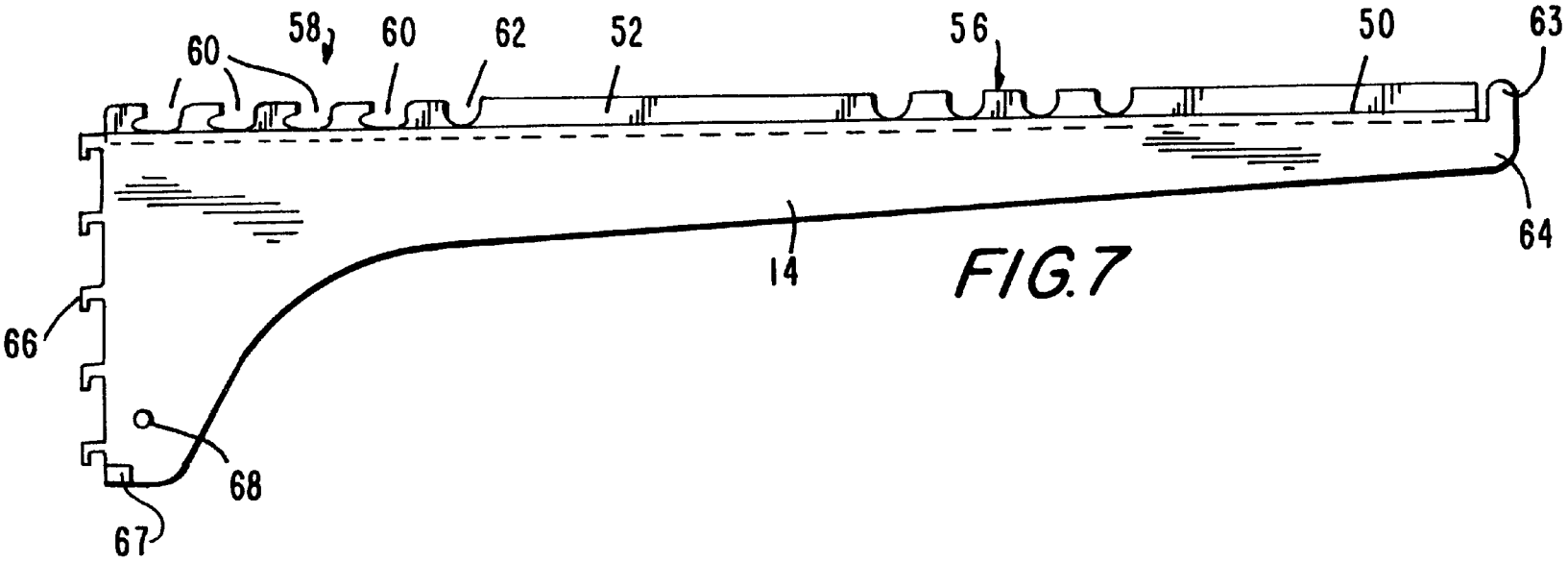
FIG. 7 is a side elevational view of the bracket of FIG. 5.
Figure 8:
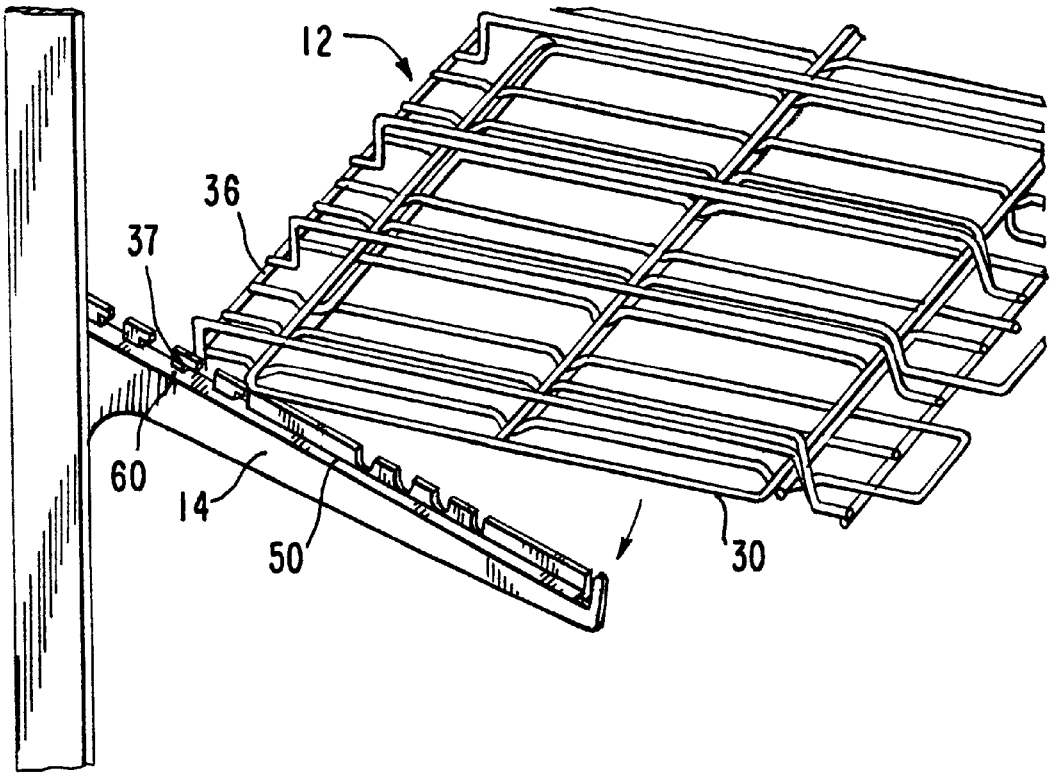
FIG. 8 is a perspective view of the shelf assembly illustrating the method of mounting.

Referring to FIGS. 5–7, the brackets 14 of the present invention include preferably inwardly-extending, horizontal support surfaces 50, adapted to support the side bars 30, 32 of the wire mat 12. Each bracket 14 also includes a flange 52 projecting upwardly from the inside edge 54 of the horizontal support surface 50. The flange 52 has a forward set of preferably four U-shaped slots 56 and a rearward set of slots 58. The rearward set of slots 58 preferably includes four L-shaped locking slots 60 and one U-shaped slot 62.

When properly placed on the brackets 14, each outwardly-projecting end 37 of the rearward end bar 36 engages one of the locking slots 60 of the bracket 14. On each side, the rearward most cross bar 22 extends through the rearward slot immediately forward of the locking slot occupied by the rearward end bar 36. Each end of the middle cross bar 20 extends through one of the slots of the forward set 56, the side bars 30, 32 resting on the horizontal support surfaces 50 of the brackets 14. The flanges 52 preferably do not project above the product support bars 16 or the cross bars 18, 20, 22 and thus do not interfere with the product supporting surface formed by the wire mat 12.

The locking slots 60 are aligned and shaped to releasably and lockingly engage the ends 37 of the rearward end bar 36 to prevent the wire mat 12 from rotating off the brackets 14. The rearward and forward slots 56, 58 are aligned and adapted such that they engage the cross bars 20, 22 to prevent the wire mat 12 from moving forward. Thus, once properly mounted, the wire mat 12 will not become unintentionally disengaged from or shift upon the brackets 14. The plurality of slots 56, 58 are spaced to provide a number of mounting positions for the wire mat 12 to accommodate various products and displays.

It can be appreciated that the wire mat 12 can be mounted in any position in which the ends 37 of the rearward end bar 36 engage one of the locking slots 60 of the rearward set 58. Thus, as depicted, the shelf assembly 10 has four positions for the wire mat 12. In each position, the rear and middle cross bars 20, 22 must extend through one of the slots 56, 58. Therefore, an extra U-shaped slot 62 is provided in the rear set 58. The locking slots 60 can also accommodate an end of the rearward cross bar 22 when the wire mat 12 is in a rearward position.

Referring to FIG. 7, the wire mat 12 is mounted to the brackets 14 by first inserting the ends 37 of the rearward end bar 36 into one of the locking slots 60. Then the wire mat is rotated downwardly until the side bars 30, 32 rest on the horizontal support surface 50 of the brackets.

Referring again to FIGS. 6 and 7, the bracket 14 also includes an arm 63 projecting upwardly from the outward end 64 thereof opposite the side bars 30, 32 with respect to the flange 52. It can be appreciated that the flange 52 prevents the wire mat 12 from sliding inwardly off the bracket 14. Similarly, the arm 63 serves to prevent the wire mat 12 from moving outwardly off the bracket 14 in a direction opposite the flange 52.

The brackets 14 preferably include mounting means, such as rearwardly and downwardly-extending hooks 66, outwardly-extending tab 67, and locking hole 68, adapted to mount on the shelving support system described in U.S. patent application Ser. No. 08/578,104 mentioned above. Alternatively, the brackets 14 can be adapted to mount to other conventional support structures.

Referring to FIG. 4, the product support rods 16 can terminate at the rearward end bar 36. However, preferably, except for the outermost rods 17, the product support rods 16 extend rearwardly a distance beyond the end bar 36 to enlarge the effective supporting area of the wire mat 12 and lengthen the product rows thereof. The outermost rods 17 can be trimmed flush with the rearward end rod 36 to avoid interference with the brackets 14 and/or support structure (not shown).

Referring to FIG. 1, the shelf assembly 10 also includes a removable rear shelf extension 70 which extends between the brackets 14 behind the wire mat 12. The shelf extension 70, which can be constructed of 22 gauge steel, has a unshaped rearward end 72 adapted to extend into and lockingly engage one of the locking slots 60 of each bracket 14, and a forward end 73 adapted to insert into and rest in another, forwardly located, slot 60. When properly mounted, the shelf extension 70 projects over the portion of the flange 52 between the engaged slots, the ends 72 and 73 contacting the horizontal support surface 50, thereby providing a rigid support for the shelf extension 70. The shelf extension 70 also includes a top surface 74 which is co-planar with the product supporting surface formed by the wire mat 12. Thus, the shelf extension 70 creates an extension of the effective product supporting surface when the wire mat 12 is in a forward position.

It can be appreciated that the present invention provides a novel shelf assembly which is light-weight, strong and economical to manufacture while providing control for products supported thereon and adjustability to adapt to various products and displays.

It should be understood, of course, that the specific form of the invention herein illustrated and described is intended to be representative only, as certain changes may be made therein without departing from the clear teachings of the disclosure. Specifically, and by way of example only, the shelf brackets 14 can be adapted to mount directly to the vertical supports 40 of a conventional gondola system 18 without departing from the spirit and scope of the invention. Accordingly, reference should be made to the following appended claims in determining the full scope of the invention.

I claim:

1. A shelf assembly comprising:

(a) two brackets;

(b) a wire mat adapted to mount to said brackets, said wire mat forming a substantially planar product supporting surface and including (i) a plurality of spaced-apart product support bars aligned substantially parallel to said brackets;

(ii) said product support bars having a plurality of downwardly-extending, U-shaped portions, corresponding U-shaped portions being aligned in rows, said rows being aligned substantially perpendicular to said product support bars; and (iii) a plurality of cross bars, each of said cross bars extending through and being joined to one of said rows of said U-shaped portions;

(c) said U-shaped portions and said cross bars being sized such that top portions of said cross bars are aligned with top portions of said product support bars to form said substantially planar product supporting surface;

(d) said wire mat including stiffening members welded to bottom surfaces of said U-shaped portion; and (e) said stiffening members extending underneath and being aligned substantially parallel to said cross bars and being spaced a distance from said cross bars to thereby impart rigidity to said wire mat.

2. A shelf assembly as in claim 1, wherein (a) said wire mat further comprises side bars connected to ends of said cross bars, said side bars being adapted to contact said brackets to support said wire mat; and (b) said stiffening members having lengths less than a distance between said brackets so as not to interfere with said brackets during mounting and removal of said wire mat.

3. A shelf assembly as in claim 1, wherein said wire mat further comprises guide rails extending above and over said product support rods, pairs of said guide rails defining discrete product channels of said product supporting surface for organizing and controlling product movement thereover.

4. A shelf assembly as in claim 3, wherein said wire mat includes a plurality of rows of closely-spaced guide rails defining gaps between adjacent product channels.

5. A shelf assembly as in claim 3, wherein (a) pairs of cantilevered ends of said product support rods are connected by individual front rods forming channel extensions of said product channels; and (b) guide rails are aligned to center said product channels over said channel extensions.

6. A shelf assembly as in claim 5, further comprising a label holder mounted to one of said front rods, said label holder being positioned at the front of the associated product channel and being alignable with a center of said associated product channel to permit easy product identification.

7. A shelf assembly as in claim 5, wherein said guide rails further comprise an upwardly-extending portion spaced rearwardly of said front rods to provide uninterrupted visual access to side portions of products.

8. A shelf assembly as in claim 1, wherein (a) said brackets include means to mount said wire mat in a plurality of positions;

(b) said wire mat includes a rearward end bar welded underneath rearward portions of said product support rods, said rearward end bar including ends adapted to engage said mounting means of said brackets;

(c) said rearward ends of said product support bars extending rearwardly beyond said rearward end bar thereby extending said product supporting surface.

9. A shelf assembly as in claim 6, wherein two extreme outward product support bars terminate at said rearward end bar.

10. A shelf assembly as in claim 8, wherein (a) said mounting means of each bracket further comprises:

(i) a horizontal support surface adapted to support said side bars of said wire mat;

(ii) a flange extending upwardly from said horizontal support surface; and (iii) forward and rearward sets of mounting slots in said flange, at least one slot of said rearward set of each bracket including means to releasably, lockingly engage an end of said rearward bar;

(b) a rearmost cross bar extending through a slot of said rearward set of each bracket and a middle cross bar extending through a slot of said forward set of each bracket; and (c) said end of said rearward end bar lockingly engaging one of said rearward slots of each bracket.

11. A shelf assembly as in claim 10, wherein at least one of said rearward slots is adapted to alternately releasably lockingly engage an end of said rearward end bar, or to accept an end of said rearmost cross bar extending therethrough such that said wire mat can be securely mounted to said brackets in a plurality of positions.

12. A shelf assembly as in claim 10, wherein each bracket further comprises an arm extending upwardly from a forward end of said bracket, said arm being opposite one of said side bars with respect to the flange of the associated bracket to provide lateral stability to said wire mat.

13. A shelf assembly as in claim 1, wherein said product supporting rods and said U-shaped portions thereof are integral and in one piece.

14. A shelf assembly as in claim 10 further comprising a shelf extension removably mountable between said brackets behind said wire mat, said shelf extension having a top surface substantially co-planar with said substantially planar product-supporting surface.

* * * * *